United States Patent [19]

Arnold et al.

[11] 4,123,291

[45] Oct. 31, 1978

[54] METHOD OF TREATING STEEL STRIP AND SHEET SURFACES, IN SULFUR-BEARING ATMOSPHERE, FOR METALLIC COATING

[75] Inventors: Jerry L. Arnold, Franklin; Frank C. Dunbar, Monroe; Alan F. Gibson, Middletown; Marvin B. Pierson, Franklin, all of Ohio

[73] Assignee: Armco Steel Corporation, Middletown, Ohio

[21] Appl. No.: 753,622

[22] Filed: Dec. 23, 1976

[51] Int. Cl.[2] ..... C23C 11/08

[52] U.S. Cl. ..... 148/6.35; 148/16; 427/248 E; 427/32 D; 427/321

[58] Field of Search ..... 427/319, 320, 321, 248 E, 427/160; 148/6.35, 16

[56] References Cited

U.S. PATENT DOCUMENTS

| | | | |
|---|---|---|---|
| 1,141,770 | 6/1915 | Carnahan | 148/6.35 |
| 1,672,180 | 6/1928 | Smith | 148/6.35 |
| 2,110,893 | 3/1938 | Sendzimir | 427/229 |
| 2,197,622 | 4/1940 | Sendzimir | 427/251 |
| 3,936,543 | 2/1976 | Byrd et al. | 427/320 |

FOREIGN PATENT DOCUMENTS

| | | | |
|---|---|---|---|
| 701,685 | 12/1953 | United Kingdom | 148/6.35 |

*Primary Examiner*—Ronald H. Smith
*Assistant Examiner*—Evan K. Lawrence
*Attorney, Agent, or Firm*—Melville, Strasser, Foster & Hoffman

[57] ABSTRACT

A method of preparing the surfaces of steel strip and sheet stock for fluxless hot dip coating with molten metal by passing the stock through a first heating zone containing the hot gaseous products of combustion of a sulfur-bearing gaseous fuel with air, continuing the heating in a further heating zone, and cooling the stock approximately to the temperature of the molten coating metal in a reducing atmosphere. The radiant energy absorptivity of the stock is increased by forming a visible sulfur and oxygen rich layer thereon in the first heating zone and preserving the layer throughout the further heating zone. Coke oven gas may be used as fuel in the first heating zone.

9 Claims, 2 Drawing Figures

METHOD OF TREATING STEEL STRIP AND SHEET SURFACES, IN SULFUR-BEARING ATMOSPHERE, FOR METALLIC COATING

BACKGROUND OF THE INVENTION

1. Field of the Invention

This invention relates to hot dip metallic coating of steel strip and sheet stock and more particularly to a method of preliminary treatment of the surfaces of the stock in a sulfur-containing atmosphere to develop initially a sulfur and oxygen rich film, to preserve this film during further heating, and to reduce the film while cooling the stock prior to immersion thereof in a molten coating metal bath. The invention has utility in the coating of carbon steels, low carbon rimmed steels, low carbon aluminum killed steels, and low alloy steels by molten coating metals such as zinc, zinc alloys, aluminum, aluminum alloys, and terne. Low alloy steels which may be treated by the process of the invention contain up to about 3% aluminum, up to about 1% titanium, up to about 2% silicon, or up to about 5% chromium, and mixtures thereof, with the remainder of the composition typical of carbon steel, as defined by *Steel Products Manual, Carbon Sheet Steel,* page 7 (May 1970) published by American Iron and Steel Institute. Aluminum killed steels include typical low carbon steel as defined above containing from about 0.03% to about 0.06% acid-soluble aluminum.

2. Description of the Prior Art

In the fluxless hot dip metallic coating of steel strip and sheet stock it is necessary to subject the surfaces to a preliminary treatment which provides a clean surface free of iron oxide scale and other surface contaminants, and which is readily wettable by the molten coating metal in order to obtain good adherence. Two types of in-line anneal preliminary treatments are in common use in this country, one being the so-called Sendzimir process or oxidation-reduction practice (disclosed in U.S. Pat. Nos. 2,110,893 and 2,197,622), and the other being the so-called Selas process or high intensity direct fired furnace line (disclosed in U.S. Pat. No. 3,320,085 to C. A. Turner, Jr.).

In the Sendzimir process steel strip or sheet stock is heated in an oxidizing furnace (which may be a direct fired furnace) to a temperature of about 370°-485° C. without atmosphere control, withdrawn into air to form a controlled surface oxide layer varying in appearance from light yellow to purple or even blue, introduced into a reduction furnace containing a hydrogen and nitrogen atmosphere wherein the stock is heated to about 735°-925° C. and the controlled oxide layer is completely reduced. The stock is then passed into a cooling section containing a protective reducing atmosphere, such as hydrogen and nitrogen, brought approximately to the temperature of the molten coating metal bath, and then led beneath the bath surface while still surrounded by the protective atmosphere.

In the Selas process steel strip or sheet stock is passed through a direct fired preheat furnace section, heated to a temperature about 1315° C. by direct combustion of fuel and air therein to produce gaseous products of combustion containing at least about 3% combustibles in the form of carbon monoxide and hydrogen, the stock reaching a temperature of about 425°-705° C. while maintaining bright steel surfaces completely free from oxidation. The stock is then passed into a reducing section which is in sealed relation to the preheat section and which contains a hydrogen and nitrogen atmosphere, wherein it may be further heated by radiant tubes to about 425°-925° C. and/or cooled approximately to the molten coating metal bath temperature. The stock is then led beneath the bath surface while surrounded by the protective atmosphere. The process may optionally include holding the stock at a selected temperature in a reducing atmosphere after reaching maximum temperature in the radiant tube section.

U.S. Pat. No. 3,936,543 issued Feb. 3, 1976, to F. Byrd et al., discloses an improvement in the Selas process, resulting in higher combustion efficiency and better production rates, wherein strip and sheet stock is heated to about 540°-705° C. in a direct fired preheat furnace section heated to at least about 1205° C. and containing gaseous products of combustion ranging from about 3% by volume oxygen to about 2% by volume excess combustibles in the form of carbon monoxide and hydrogen, followed by heating in a reducing section containing at least about 5% hydrogen by volume to a temperature of at least about 675° C. Preferably the preheat furnace atmosphere contains 0% oxygen and 0% excess combustibles, i.e., perfect combustion.

In all prior art processes for preliminary treatment of steel strip and sheet surfaces which are exposed to atmospheres of direct fired furnaces, it has been considered that the presence of even small amounts of sulfur in the atmosphere would be highly deleterious. Accordingly, substantially sulfur-free fuel such as natural gas has been prescribed for use in such furnaces. However, natural gas shortages have made it necessary to consider alternative sources of fuel. In a steel mill having coke ovens, the use of coke oven gas as a fuel source would be an obvious choice except for the fact that raw coke oven gas ordinarily contains about 300 to 500 grains of sulfur per 100 cubic feet of gas, the sulfur being present primarily as hydrogen sulfide with a small amount of organic sulfur compounds. Although the gas can be easily scrubbed to a sulfur level of about 75 to 100 grains per 100 cubic feet, and more recently even to a level of about 25 to 40 grains per 100 cubic feet, it has nevertheless been generally considered that preliminary treatment methods involving exposure of steel strip surfaces to atmospheres containing products of combustion could not tolerate even the lower sulfur levels of scrubbed coke oven gas. Accordingly, it has been feared that curtailment of natural gas supply would force the shutdown of coating lines equippd with direct fired furnaces for preliminary treatment of steel strip and sheet material.

SUMMARY OF THE INVENTION

The present invention constitutes a discovery that sulfur-bearing coke oven gas can be used as a fuel in direct fired furnaces for preliminary treatment of the surfaces of steel strip and sheet stock, and that greater increases in energy efficiency and/or production rates can be achieved in both the Sendzimir and Selas processes (as modified by the above Byrd et al. patent) by increasing the radiant energy absorptivity of the steel stock. This absorptivity is increased by forming a film or layer rich in sulfur and oxygen on the stock surfaces in the initial direct fired (or preheat) furnace section, and by preserving this film throughout the heating sections.

It has been found that a film rich in sulfur and oxygen, which is thin and uniform, can be readily formed on the stock surfaces, and that this film can be easily reduced in a subsequent cooling section to produce a fresh ferrous surface which is readily wetted by molten coating metal, with resultant excellent adherence after solidification of the coating.

Accordingly, the present invention provides a method of preparing the surfaces of steel strip and sheet stock for fluxless hot dip coating with molten metal, comprising the steps of passing the stock through a heating zone containing an atmosphere of gaseous products of combustion including from about 5 to about 1600 grains of sulfur per 100 cubic feet of fuel under conditions causing the formation of a visible sulfur and oxygen rich film on the surfaces of the stock, continuing the heating of the stock in a further heating zone isolated from the first-mentioned heating zone in an atmosphere containing less than 5% hydrogen, by volume, thereby preserving the sulfur and oxygen rich film, and cooling the stock in a cooling zone isolated from the preceding heating zones, the cooling zone containing at least 10% hydrogen by volume.

In the cooling zone the stock is cooled approximately to the temperature of the molten coating metal, and it has been found that the sulfur and oxygen rich film can be completely reduced in the cooling zone since this film is both easier to form and more easily reduced than an iron oxide layer or film.

The temperature to which the stock is heated in the successive heating zones is not critical so long as the formation of a thick sulfur and oxygen containing scale is avoided. In general, the temperatures may be the same as those described above for conventional practice, i.e., for the Sendzimir process a range of about 370°–485° C. in the oxidizing furnace and about 735°–925° C. in the further heating zone; and for the process of the Byrd et al. patent a range of about 540°–705° C. in the direct fired preheat section and at least about 675° C. and up to about 925° C. in the radiant tube heating section. The stock may be held at a selected temperature, after passage through the radiant tube section, for a short period of time (in order to improve formability or to modify the mechanical properties), and the atmosphere in the holding section is preferably reducing, but may contain less than 5% hydrogen.

Due to the dark coloration of the sulfur and oxygen rich layer, the heat absorptivity of the stock is greatly increased, thereby decreasing the residence time in the heating zones if the radiant tube furnace temperatures are maintained at conventional levels. Hence this results in an increased production rate. Alternatively, the radiant tube furnace temperatures could be reduced somewhat, thereby maintaining the same production rate at lower fuel requirements. It is of course evident that a balance between increased production rate and lower fuel requirements could also be effected.

It is an essential feature of the process that the further heating zone have an atmosphere containing less than 5% hydrogen by volume and substantially isolated from the atmospheres of the other zones. A gas inert to the sulfur and oxygen rich layer, preferably nitrogen, is used.

The residence times in the various zones are variable and depend upon strip thickness, speed and related factors. The temperature to which the stock is brought in each zone occurs at or near the exit therefrom, so that there is substantially no holding time at temperature, as is customary in continuous annealing practice.

BRIEF DESCRIPTION OF THE DRAWING

Reference is made to the accompanying drawing wherein.

DESCRIPTION OF THE PREFERRED EMBODIMENTS

Figure 1:
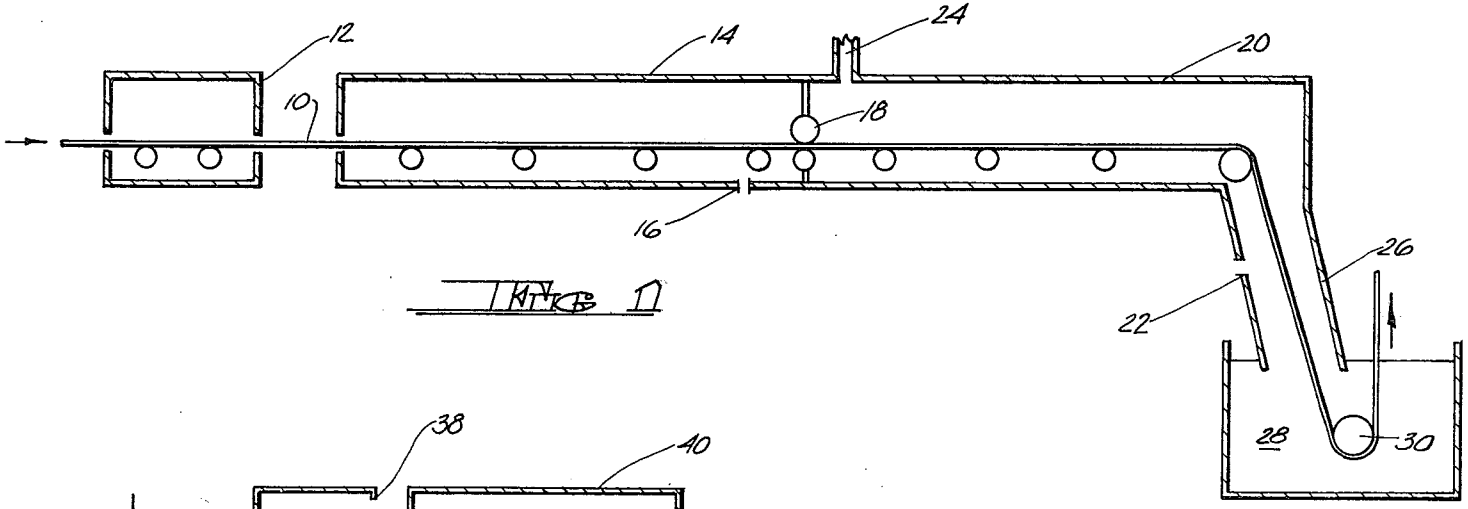
FIG. 1 is a diagrammatic illustration of a Sendzimir line modified to practice the present invention.

Referring to FIG. 1, steel strip to be treated is indicated at 10, the direction of travel being shown by arrows. An oxidizing furnace is shown at 12, which is heated to a temperature of, e.g., about 870° C. by combustion of scrubbed coke oven gas. A second heating section, which may be a radiant tube furnace, is shown at 14. An inlet for nitrogen into the second heating section is provided as shown at 16. Baffle means 18 are provided between heating section 14 and cooling section 20, which isolate the atmospheres in each section from one another. A hydrogen inlet into cooling section 20 is shown at 22, and a stack for flaring hydrogen is provided as shown at 24. A protective snout 26 extends downwardly beneath the surface of a coating metal bath 28, which surrounds strip 10 as it is conducted beneath the surface of the bath, around a reversing roll 30 and vertically upwardly out of the bath. Any conventional finishing means (not shown) may be used for metering and solidifying the metal coating.

Since the oxidizing furnace 12 and heating section 14 are separate, with heated strip 10 exposed to atmosphere therebetween, it is evident that the atmospheres of each are isolated from one another.

Figure 2:
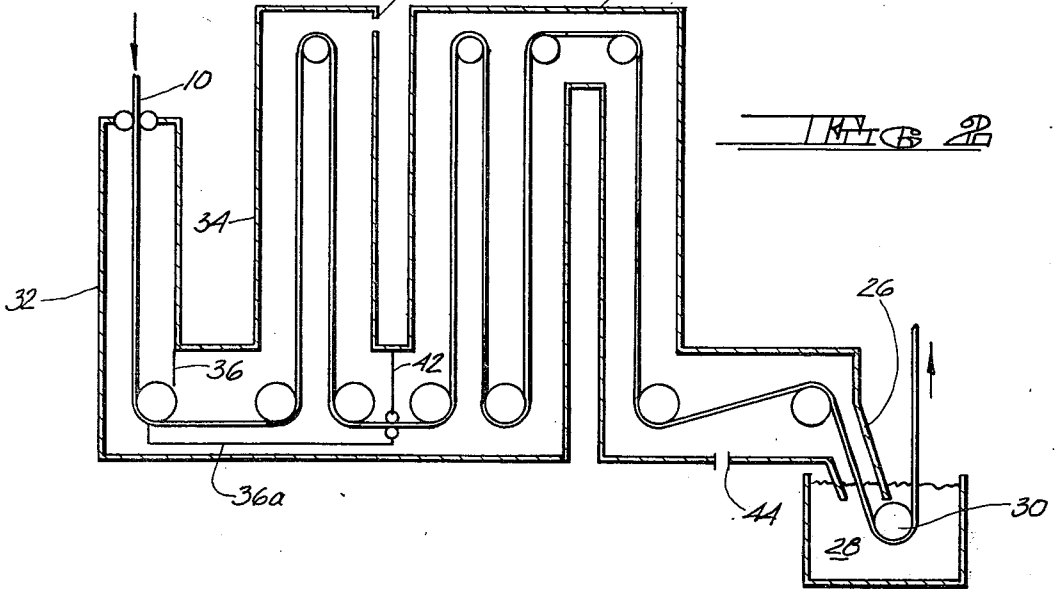
FIG. 2 is a diagrammatic illustration of a Selas line modified to practice the present invention.

Referring to FIG. 2, strip 10 to be treated is shown as in FIG. 1. A direct fired preheat furnace is shown at 32, which is heated to a temperature, e.g., of at least about 1205° C., by direct combustion of scrubbed coke oven gas and air. A further heating section, which is preferably a radiant tube furnace is shown at 34, and baffle means 36, **36*a* are provided between the preheat furnace 32 and radiant tube furnace 34, thus isolating one from the other. An inlet for nitrogen into furnace 34 is shown at 38, and baffle means 42 is provided isolating cooling section 40 from the radiant tube furnace 34. An inlet for hydrogen or a hydrogen-nitrogen mixture into cooling section 40 is shown at 44. The protective snout 26, coating metal bath 28 and reversing roll 30 are the same as described above in FIG. 1**.

As an alternative arrangement, isolation of the atmosphere in the radiant tube furnace 34 from the atmospheres in the preheat furnace 32 and in the cooling section 40 can be effected by providing a sufficiently large flow of nitrogen through inlet 38 into furnace 32 so as to block entry of hydrogen into furnace 34 from section 40, thereby eliminating the need for baffles 36, **36*a* and 42**.

The remaining elements shown in FIGS. 1 and 2 are conventional and require no discussion since the functions thereof are well known to those skilled in the art.

While it is preferred from the standpoint of economics to operate the preheat furnace zone under perfect combustion conditions (0% excess combustibles and 0% oxygen), it is within the scope of the invention to operate with an atmosphere ranging from up to about 2% free oxygen by volume up to about 2% by volume excess combustibles in the form of carbon monoxide and hydrogen.

Preferably the atmosphere in the cooling zone is a mixture of about 20 to 40% hydrogen by volume, and balance nitrogen; a minimum of 10% hydrogen by volume is believed to be essential.

When practicing an anneal cycle the stock is brought to a temperature of about 427° to about 705° C. in the preheat zone and to a maximum temperature of about 788° C. in the radiant tube zone. When practicing a full hard cycle the stock is brought to a maximum temperature of about 565° C. in the preheat zone and a maximum of about 538° C. in the radiant tube zone. In the full hard cycle the hydrogen content in the cooling zone is preferably increased to about 40% by volume.

The amount of sulfur present in the coke oven fuel and in the atmosphere of the preheat furnace has been found to have little effect on the nature of the sulfur and oxygen rich film formed on the strip surfaces and may be varied from about 5 to about 1600 grains per 100 cubic feet in the coke oven gas (about 0.007% to about 2.6% hydrogen sulfide by volume at standard temperature and pressure). Similarly, variations in sulfur content have little influence on coating metal adherence except in the practice of a full hard cycle wherein the maximum strip temperature is about 565° C. Under these conditions an increase in the hydrogen content in the cooling zone to about 40% by volume will result in improvement in coating adherence, as indicated above.

The method of the invention is applicable to any type of generally used coating metal including, but not limited to, aluminum, alloys of aluminum, zinc, alloys of zinc, and terne.

As indicated above, this invention has utility in the coating of any type of steel strip and sheet stock in thicknesses generally used for hot dip metallic coating, including carbon steel, low carbon rimmed steel, low carbon aluminum killed steel, low carbon columbium and/or titanium treated steels, and low alloy steels of the type disclosed in U.S. Pat. No. 3,905,780 to J. C. Jasper et al. Low alloy steels of this type, containing alloying elements more readily oxidizable than iron in an amount greater than a critical content, previously could be successfully prepared for hot dip coating only by a process disclosed in U.S. Pat. No. 3,925,579 to C. Flinchum et al., which included subjecting the steel to strongly oxidizing conditions in the initial heating stage. Since the sulfur and oxygen rich film of the present process is more easily formed than an oxide film, it is an advantage of the present invention that the steel need not be subjected to oxidizing conditions as strong as those required in the Flinchum et al. patent, for steels containing alloying elements in amounts greater than the critical content thereof, as defined in that patent.

Although not shown in the drawing, a holding section may be provided between the radiant tube section 14 and the cooling section 20 of FIG. 1 or radiant tube section 34 and cooling section 40 of FIG. 2. As indicated above, some installations include such a holding section in order to maintain the stock at some predetermined temperature, after reaching the peak temperature in the radiant tube section, for the purpose of improving the formability or general mechanical properties of the stock. This is considered to be within the scope of the present invention, and such a control zone will preferably be supplied with an atmosphere containing at least 10% hydrogen by volume, although the atmosphere could be non-reducing in order to preserve the oxygen and sulfur rich film until the stock reaches the cooling section.

The embodiments of the invention in which an exclusive property or privilege is claimed are defined as follows:

1. A method of preparing the sufaces of steel strip and sheet stock for fluxless hot dip coating with molten metal, comprising the steps of passing the stock through a furnace heated by direct combustion with air of gaseous fuel containing sulfur compounds ranging from about 5 to about 1600 grains of sulfur per 100 cubic feet of fuel to produce an atmosphere of gaseous products of combustion containing sulfur and from about 2% free oxygen by volume to about 2% by volume excess combustibles in the form of carbon monoxide and hydrogen in which atmosphere said stock is heated to about 540° to about 705° C., thereby causing the formation of a visible sulfur and oxygen rich layer on the stock surfaces, continuing the heating of said stock in a further heating zone isolated from said furnace in an atmosphere consisting of a gas inert to said sulfur and oxygen rich layer and less than 5% hydrogen by volume, thereby preserving said layer, and cooling said stock approximately to the temperature of the molten coating metal in a cooling zone isolated from said heating zones, said cooling zone containing a reducing atmosphere comprising at least 10% hydrogen by volume, whereby to reduce said sulfur and oxygen rich layer completely to a metallic iron surface wettable by said coating metal.

2. The method claimed in claim 1, wherein said stock is heated to about 675° to 925° C. in said further heating zone.

3. The method claimed in claim 1, wherein said further heating zone is a radiant tube furnace.

4. The method claimed in claim 1, wherein said gaseous fuel is coke oven gas.

5. The method claimed in claim 1, including the step of holding said stock at a selected lower temperature in a control zone in a reducing atmosphere containing at least 10% hydrogen by volume after passing through said further heating zone and prior to the cooling of said stock.

6. A method of preparing the surfaces of steel strip and sheet stock for fluxless hot dip coating with molten coating metal, comprising the steps of passing the stock through a furnace heated by direct combustion with air of gaseous fuel containing sulfur compounds ranging from about 5 to about 1600 grains of sulfur per 100 cubic feet of fuel to produce an atmosphere of gaseous products of combustion containing sulfur and from about 2% free oxygen by volume to about 2% by volume excess combustibles in the form of carbon monoxide and hydrogen in which atmosphere said stock is heated to about 370° to 485° C., passing said stock into outside atmosphere, thereby causing the formation of a visible sulfur and oxygen rich layer on the stock surfaces, continuing the heating of said stock in a further heating zone isolated from said furnace in an atmosphere consisting of a gas inert to said sulfur and oxygen rich layer and less than 5% hydrogen by volume, thereby preserving said layer, and cooling said stock approximately to the temperature of the molten coating metal in a cooling zone isolated from said heating zones, said cooling zone containing a reducing atmosphere comprising at least 10% hydrogen by volume, whereby to reduce said sulfur and oxygen rich layer completely to a metallic iron surface wettable by said coating metal.

7. The method claimed in claim 6, wherein said stock is heated to about 735° to 925° C. in said further heating zone.

8. In a method of preparing the surfaces of steel strip and sheet stock for fluxless hot dip coating with molten metal, including the steps of passing the stock through a first heating zone under conditions which form a visible iron oxide layer on the stock surfaces, continuing the heating of said stock in a further heating zone in a reducing atmosphere to reduce said oxide layer to a metallic iron surface, and cooling said stock approximately to the temperature of the molten coating metal in a protective reducing atmosphere to maintain said iron surface, the improvement which comprises forming a visible sulfur and oxygen rich layer on said stock surfaces in said first-mentioned heating zone to increase the radiant energy absorptivity of said stock, preserving said layer throughout said further heating zone by maintaining thereon an atmosphere inert to said layer, and thereafter reducing said layer to a metallic iron surface wettable by said coating metal in a reducing atmosphere containing at least 10% by volume hydrogen during said cooling of said stock.

9. The improvement claimed in claim 8, including the step of holding said stock at a selected lower temperature after said further heating zone and prior to the cooling thereof.

* * * * *